US006905764B2

(12) United States Patent
Hornez et al.

(10) Patent No.: US 6,905,764 B2
(45) Date of Patent: Jun. 14, 2005

(54) SEWING THREAD AND METHOD FOR PRODUCING SUCH AS A SEWING THREAD

(75) Inventors: Pierre Hornez, Wervicq-Sud (FR); Mathias Wittmann, Neusaess (DE); Karl Greifeneder, Heilbronn (DE)

(73) Assignee: Amann & Soehne GmbH & Co. KG, Boennigheim (DE)

( * ) Notice: Subject to any disclaimer, the term of this patent is extended or adjusted under 35 U.S.C. 154(b) by 0 days.

(21) Appl. No.: 10/837,756

(22) Filed: May 4, 2004

(65) Prior Publication Data

US 2004/0265580 A1 Dec. 30, 2004

(30) Foreign Application Priority Data

May 3, 2003 (DE) ..... 103 20 099
Apr. 8, 2004 (DE) ..... 10 2004 018 121

(51) Int. Cl.[7] ..... D01F 6/00

(52) U.S. Cl. ..... 428/357; 428/370; 428/399; 57/210; 57/903; 57/244

(58) Field of Search ..... 428/357, 370, 428/399; 57/244, 210, 903, 905

(56) References Cited

U.S. PATENT DOCUMENTS 3,775,960 A 12/1973 Ogawa et al.
5,429,868 A * 7/1995 Truckenmuller et al. ... 428/357

FOREIGN PATENT DOCUMENTS

| | | |
|---|---|---|
| EP | 0156503 | 10/1985 |
| EP | 1275758 | 1/2003 |
| JP | 11107036 | 4/1999 |
| JP | 2001348749 | 12/2001 |
| JP | 2002054047 | 2/2002 |
| WO | 0168962 | 9/2001 |
| WO | 0231241 | 4/2002 |
| WO | 2004063442 | 7/2004 |

OTHER PUBLICATIONS

Casey et al, "Elastic PTT Staple Spun Yarns and Fabrics", Shell Oil Company, Bd. 445, No. 45, May 2001 (XP007128152.

* cited by examiner

*Primary Examiner*—N. Edwards
(74) *Attorney, Agent, or Firm*—Dennison, Schultz, Dougherty & McDonald

(57) ABSTRACT

A sewing thread made of synthetic fibers is described, whereby the ready-to-use sewing thread has an elongation at break between 25% and 85% and an elastic tensile elongation of between 30% and 95% of the elongation, determined by a measuring strength, corresponding to 70% of the absolute strength of the respective sewing thread. In addition, two methods for making a sewing thread are also described, whereby the sewing thread comprises either a plied yarn or an air-intermingled sewing thread.

To produce this sewing thread yarn components with an elongation at break between 25% and 85% and an elastic tensile elongation of between 30% and 95% are selected, whereby thermal and preferably hydrothermal treatment is carried out after the actual yarn production.

21 Claims, No Drawings

SEWING THREAD AND METHOD FOR PRODUCING SUCH AS A SEWING THREAD

The present invention relates to a sewing thread having the characteristics of the preamble of claim 1, as well as two methods for producing such a sewing thread.

Sewing threads are known in various structures. For example, EP 0 295 601 A describes a sewing thread consists of multifilament synthetic fibers, whereby the known sewing thread has the structure of an air-intermingled sewing thread, such that a multifilament first core thread component is intermingled by means of an air stream with a second effect thread component. This intermingling causes the individual filaments of such a sewing thread to be intermixed with one another in the manner of a loop or a curve, thus creating the cover of the sewing thread required for the sewing procedure.

A second, basic sewing thread structure is described in EP 0 569 891 A. Here, a multifilament first yarn component is spun over by a second yarn component, whereby at least two, preferably three, such roves are twisted with one another to create the finished core yarn, so that the twisting can then produce the relevant cover. In order to prevent unwanted untwisting of such a twisted core yarn during processing, prior to twisting the roves comprising at least two yarn components are given a twist, whereby the direction of twist hereof is opposite to the direction of twist of the ply twist.

EP 0 569 890 A discloses a third, basic structure of a sewing thread. Here, this known sewing thread structure forms the sewing thread as plied yarn, whereby this plied yarn has at least two, though preferably three, multifilament yarn components. Each yarn component constituting the plied yarn is likewise given initial twisting prior to twisting, whereby the pretwisting of each multifilament yarn component with respect to its direction is opposite to the direction of twisting.

EP 0 919 649 A discloses a sewing thread made of synthetic multifilaments, whereby the known sewing thread has at least two yarn components, whereof the individual filaments are in each case aligned parallel to one another. Both these yarn components are twisted with one another, whereby to achieve the required thread cover both yarn components twisted with one another over their entire surface are provided with a polymer coating. In other terms this known sewing thread has two multifilament yarn components twisted with one another, whereby, however, in each yarn component all filaments are aligned parallel to one another. To prevent shifting of both yarn components relative to one another during the sewing procedure with this particular sewing thread structure, the known sewing thread is sheathed full-surface by the polymer coating, such that no filaments accordingly make contact for example with the thread break or the reversing elements on the thread break of the sewing machine or when the sewing thread is reversed, because the polymer sheathing prevents such contact. With this embodiment of the sewing thread the cover required for the sewing method is primarily made available by the full-surface coating (sheathing).

The above described known sewing threads, which exhibit the structure of a core yarn, an intermingled sewing thread, a plied sewing thread or a fully coated sewing thread, are used only in a limited way for sewing elastic articles. For this it is generally required to construct the thread when using the known sewing threads, such that the known sewing threads with a excess yarn length are present in the seam, so that also the otherwise inflexible seam has a certain elasticity, unfortunately including the disadvantage of requiring a considerably greater sewing thread requirement.

The object of the present invention is to provide a sewing thread in particular for use in elastic articles, which can be applied particularly economically.

This problem is solved according to the present invention by a sewing thread having the characterizing features of claim 1.

As with the initially described known sewing threads, the inventive sewing thread comprises multifilament synthetic fibers and/or spun yarns. By way of comparison however the inventive ready-to-use sewing thread has an elongation at break (tensile strength elongation) between 25% and 85%, whereby this elongation at break and the absolute strength are determined in a conventional manner by a known stress strain testing in accordance with DIN EN ISO 2062. Furthermore, the inventive sewing thread has an elastic tensile elongation, of between 30% and 95% of elongation, determined by a measuring strength, corresponding to 70% of the absolute strength of the respective sewing thread. Here the term elastic tensile elongation expresses that after corresponding repeated strength loading and subsequent relief the inventive sewing thread still has an elasticity of the above mentioned magnitude. The feature of the elastic tensile elongation utilized repeatedly in the present invention for characterizing the inventive sewing thread and the method is determined such as is described herein below in detail in the example.

It was surprisingly discovered that this type of sewing thread can be used trouble-free for seams and in particular also for sewing elastic articles, even though experts had assumed to date that such a highly-elastic sewing thread cannot be sewn fault-free and in particular also not by machine.

Elastic articles in terms of the present application are all those articles, which experience a reversible increase in length under strength loading, i.e. with application of strength (force), whereby the term elastic article covers in particular knitted and woven ready-to-wear items from underwear, swimwear, sports clothing, blouses, T-shirts, sweatshirts, pullovers and corsetry as well as elastic and especially woven outer garments, for example elastic pants and preferably elastic jeans, and elastic technical articles, such as for example automobile seat covers.

The term spun yarns, corresponding to the terms staple fiber yarn or spun thread, and used in the present text, designates those threads, which are made, preferably spun, out of a plurality of separate fibers (staple fibers) with restricted length, for example a staple length between 12 mm and 160 mm.

In particular, the first essential advantage of the inventive sewing thread is that such seams can be made, which also produce elastic seams without providing the previously described excess yarn lengths in the seam, through use of the inventive sewing thread in elastic articles, as is constantly required with known sewing threads. This advantage is particularly valid when the inventive sewing thread is used to produce double lockstitch seams of the stitch type 301 according to DIN 61,400, whereby the inventive sewing thread has only a thread breakage frequency of less than two thread breaks/hour during continuous operation on double lockstitch machines at speeds between 2500 rpm up to 5000 rpm and a stitch density of up to 5 stitches/cm.

In addition, the seams made using the inventive sewing thread, in particular double lockstitch seams, has excellent seam elasticity, which is also present when there is no excess yarn length or only minimal excess yarn length of the sewing thread in such a seam, whereby the high elasticity of the inventive sewing thread and in particular the high elastic tensile elongation of same ensures also that after repeated strength loading and after repeated overloading of the seam there is no unwanted gaping of the seam, as the sewing thread adapts to the elasticity of the elastic article. Apart from the above described outstanding sewing capacity, and also with the use of the finest needles, and its elastic behavior with the inventive sewing thread there is also no unwanted distortion or dislocation of the inventive sewing thread in the seam, so that the seams created using the inventive sewing thread constantly give a perfect and optimal appearance, and are further distinguished by a high degree of fleeciness, softness and suppleness, so that the inventive sewing thread is viewed as particularly pleasant in particular for ready-to-wear items worn next to the skin and thus a high degree of wearing comfort. On account of the above mentioned high degree of fleeciness, softness and suppleness of the inventive sewing thread the latter also enables sewing of several superposed layers of material, without a seam thus created being experienced as bothersome when the ready-made item is being worn.

With the seams made using the inventive sewing thread no excess yarn length or only a clearly reduced excess yarn length is provided in this seam, the inventive sewing thread, which, as already shown, has excellent machine sewing capacity, can be worked particularly economically, whereby this sewing thread economy, compared to conventional sewing threads, which need a correspondingly large excess yarn length in the seam, is between 20% and 40%, relative to the sewing thread length required for the seam to be created in each case and in particular also in the case of a double lockstitch seam (double-thread lock stitch-seam).

The above described advantages are emphasized if the inventive sewing thread has an elongation at break between 35% and 70% and if with this embodiment the inventive sewing thread has an elastic tensile elongation of between 50% and 80% of the elongation, determined by a measuring strength, corresponding to 70% of the absolute strength of the respective sewing thread. This confirmed that this preferred embodiment of the inventive sewing thread could be applied universally in a plurality of elastic articles, distinguished by the degree of their elasticity, whereby double lockstitch seams are created by machine under the above conditions, in particular with the inventive sewing thread.

Basically, the inventive sewing thread can contain any synthetic fiber as multifilament synthetic fiber, which lends the finished sewing thread the above mentioned elongation at break and the above mentioned elastic tensile elongation. Therefore the inventive sewing thread can have corresponding polyethylene-terephthalate fibers or polyamide 6- or polyamide 6.6 fibers, or can consist of these fibers.

But it is particularly appropriate if the inventive sewing thread has at least one yarn component, comprising a chemically modified polyester fiber, whereby a multifilament poly-trimethylene-terephthalate fiber or a spun yarn to be made out of poly-trimethylene-terephthalate fibers is to be produced as particularly preferred chemically modified polyester fiber. In other terms the inventive sewing thread contains either the above mentioned multifilament poly-trimethylene-terephthalate fibers or the above mentioned spun yarns of poly-trimethylene-terephthalate fibers, or the inventive sewing thread in particular comprises at least a multifilament poly-trimethylene-terephthalate fiber and/or at least a spun yarn made of poly-trimethylene-terephthalate fibers.

With respect to the structure of the inventive sewing thread the inventive sewing thread can have those structures as described initially in the prior art, insofar as is assured that such a structure of the inventive sewing thread has an elongation at break between 25% and 85%, preferably between 35% and 70%, and an elastic tensile elongation of between 30% to 95% and in particular between 50% and 80% of the elongation, determined by a measuring strength, corresponding to 70% of the absolute strength of the respective sewing thread.

But it is particularly appropriate if the inventive sewing thread has the structure of a plied sewing thread, whereby the latter plied sewing thread, further distinguished by excellent processing behavior, has at least two twisted yarn components and preferably three twisted yarn components. It was surprisingly found that such a thread structure lends the resulting seam outstanding elasticity, even though conventional sewing threads are distinguished structurally by a relatively inelastic behavior.

In particular whenever the twisted yarn components forming the plied sewing thread are given pretwisting, whereby preferably this pretwisting is in an S-direction, and the pretwisted twisted yarn components are twisted with one another to form the plied sewing thread, whereby this plied thread twisting is done preferably in the Z-direction, this type of further development of the inventive sewing thread is characterized by a high degree of fabrication security during sewing, i.e. by an even lower thread breakage frequency, in combination with a high degree of seam elasticity, so that the seams thus made also do not lose their elasticity-following repeated strength loading and relief.

A particularly suitable further development of the inventive sewing thread provides that the twisted yarn component forming the plied sewing thread has pretwisting with a twist value $\alpha$ between 50 and 130 and in particular between 70 and 100, while the resulting plied sewing thread in particular has a twist value $\alpha'$, which varies between 80 and 160 and preferably between 95 and 125.

The twist value $\alpha$ or $\alpha'$ is defined as follows:

$$\text{twist value } \alpha = \frac{\text{twists per meter}}{\sqrt{Nm}}$$

In this formula Nm means the yarn fineness (overall fineness) of each pretwisted plied thread component, indicated metrically.

$$\text{twist value } \alpha' = \frac{\text{twists per meter}}{\sqrt{Nm}}$$

In this formula Nm means the yarn fineness (overall fineness) of the total plied thread, indicated metrically.

Ranges for twist values $\alpha$ (pretwisting) or $\alpha'$ (plied thread twisting) have been specified herein above for the inventive sewing thread, which has the structure of a plied thread in the embodiment in question. If the sewing thread according to the present invention is made up of multifilament yarn components, then the twist value $\alpha$ in particular between 50 and 100 varies and the twist value $\alpha'$ between 80 and 125 varies, while when spun yarns are used to make the plied inventive sewing thread in particular the twist value $\alpha$ is between 90 and 130 and the twist value $\alpha'$ is between 115 and 160.

In an basically other, though likewise preferred and particularly suitable, embodiment of the inventive sewing thread the inventive sewing thread has the structure of a intermingled yarn, whereby the intermingled yarn includes at least a first yarn component forming the core of the yarn and at least a second yarn component intermingled with the former, such that the second yarn component forms the effect thread component. Compared to the above described plied thread structure of the inventive sewing thread this intermingled sewing thread structure lends the inventive sewing thread a particularly high degree of softness and particularly skin-friendly suppleness, such that this structure is always preferably selected whenever the inventive sewing thread is utilized to sew such elastic articles, which are worn directly against the, or which lie particularly tight against the skin.

In particular, in the above described special structure of the inventive sewing thread whenever the sewing thread is present as intermingled, both the first yarn component and the second yarn component exclusively comprises chemically modified multifilament polyester fibers and in particular exclusively comprises multifilament poly-trimethylene-terephthalate fibers such a special embodiment of the inventive sewing thread has a high degree of elasticity in connection with an optimal elastic tensile elongation portion, such that seams made of this no longer have to exhibit excess sewing thread lengths in the seam. Accordingly, such a sewing thread with high economic efficiency can be worked due to the above described sewing threads economy.

In a further development of the above described inventive sewing thread this further development also has the structure of a intermingled sewing thread, whereby however the first yarn component, i.e. the core thread component, comprises the chemically modified multifilament polyester fibers and in particular comprises the multifilament poly-trimethylene-terephthalate fiber, while the second yarn component, forming the effect thread component, comprises a polyethylene-terephthalate fiber and thus comprises a conventional multifilament polyester fiber with respect to its chemical structure.

In particular, with the above described further development whenever the mass ratio of the first yarn component to the second yarn component varies between 60:40 to 80:20, the effect thread component, in particular when it has a higher individual filament count and a lesser individual filament fineness when compared to the core thread component, completely or almost completely covers the core thread component, so that this embodiment of the inventive sewing thread is preferably selected for such sewing threads, which are offered in medium to dark color tones. It was ascertained that this further development of the inventive sewing thread lends itself for dyeing in medium to dark tones particularly well, so that accordingly such a dyed inventive sewing thread has high color fastness and preferably high wet color fastness.

To further improve the working properties of the inventive sewing thread, which has the structure of a intermingled sewing thread, without noticeably losing or impairing the required elasticity, i.e. the elastic tensile elongation, or, another further development of the inventive sewing thread provides that the sewing thread is provided with a twist of between 0 rpm and 500 rpm, in particular between 80 rpm and 250 rpm. This type of configuring of the inventive sewing thread combines optimal machine sewing properties, i.e. further reduced thread breakage frequency, with high elasticity, so that particularly tensile-sensitive elastic articles can also be sewn, preferably using a double lockstich seam of stitch type 301 (DIN 61,400).

To also prevent unwanted sagging of the seams during later usage and in particular with looking after elastic articles sewn with the inventive sewing thread, the inventive sewing thread, preferably the dyed sewing thread, has in particular hot-air shrinkage at 180° C. between 0.5% and 3% and preferably between 0.6% and 1.5% and boiling shrinkage at 98° C. in water between 0.1% and 1.5% and preferably between 0.15% and 0.8%. In this connection hot-air shrinkage is determined at 180° C. for 15 minutes, and boiling shrinkage in water at 98° C. for 15 minutes.

Basically, the strengths to be provided by the inventive sewing thread depend on which yarn components are utilized to produce the sewing thread, which sewing thread structure is selected, for which purpose and in which seam structure the inventive sewing thread is used. For particularly fine, elastic articles, in which the seam is not subjected to extreme loads, a preferred embodiment of the inventive sewing thread has absolute strength between 400 cN and 900 cN and specific strength between 10 cN/tex and 25 cN/tex, whereby such an embodiment of the inventive sewing thread has either the structure of a double plied thread, preferably made using spun yarns, or it has the structure of an air-intermingled multifilament sewing thread. By way of contrast, if such elastic articles, which are forced more strongly, are sewn using the inventive sewing thread, then such embodiments of the sewing thread are made use of, whereof the absolute strength varies in particular between 900 cN and 1300 cN and whereof the specific strength varies between 30 cN/tex and 45 cN/tex. For this application in particular multifilament triple plied threads or air-intermingled multifilament structures are used. For highly forced seams, for example seams on elastic sports articles, such embodiments of the inventive sewing thread are used, which preferably have the structure of a multifilament triple plied thread or an air-intermingled sewing thread, whereby the absolute strength varies in particular between 1,300 cN and 1,800 cN and the specific strength varies preferably between 45 cN/tex and 60 cN/tex, so that it can be a stated here in summary that the absolute strength of the inventive sewing thread is in particular between 400 cN and 1,800 cN and the specific strength of the inventive sewing thread is preferably between 10 cN/tex and 60 cN/tex and preferably between 14 cN/tex and 34 cN/tex.

Likewise, the overall fineness of the inventive sewing thread depends on the reason the inventive sewing thread is used and with which stitch type this inventive sewing thread is then sewn. It has eventuated that an overall fineness of the inventive sewing thread, which varies between 100 dtex and 1,800 dtex and preferably between 200 dtex and 1,200 dtex, covers a plurality of applications for the inventive sewing thread in sewing a broad palette of different elastic articles, so that the inventive sewing thread preferably has the above mentioned overall (total) fineness.

Embodiments of the inventive sewing thread are described herein above, which contain in particular a chemically modified polyester fiber and preferably a multifilament poly-trimethylene-terephthalate fiber, or consist thereof. In this connection these embodiments have such a chemically modified polyester fiber or such a poly-trimethylene-terephthalate fiber, whereof the individual filament count varies between 18 filaments and 90 filaments and in particular between 30 filaments and 60 filaments. This means that the corresponding, resulting inventive sewing thread, when structured as a double plied yarn, in particular has between 36 filaments and 180 filaments, and when structured as triple plied yarn, preferably has between 54 filaments and 270 filaments, whereby the filament count in a intermingled inventive sewing thread varies in particular between 36 and 180 filaments, as long as this intermingled sewing thread is structured from only one single core thread component (first yarn component) and only one single effect thread component (second yarn component).

If on the contrary the inventive sewing thread is made from a spun yarn and in particular from a spun yarn made of poly-trimethylene-terephthalate fibers, then those fibers are selected for this, whereof the staple length varies preferably between 25 mm and 110 mm and in particular between 35 mm and 90 mm.

If the inventive sewing thread also has, apart from this chemically modified polyester fiber, another conventional multifilament polyethylene-terephthalate component, such preferred yarn components are selected, which correspond in their individual filament count to the chemically modified polyester fibers or to the individual filament count (elementary filament count) of these chemically modified polyester fibers.

Those embodiments of the inventive sewing thread, in which the inventive sewing thread has a sliding value between 130 cN and 200 cN and in particular has a sliding value between 140 cN and 160 cN can be used in multiple applications in particular. It was ascertained that in keeping to these sliding values the inventive sewing thread can be used particularly well for sewing a plurality of different elastic articles, whereby in particular the preferred sliding value range guarantees that double lockstitch seams, which are particularly friendly to skin in particular in the area of underwear also, can be made easily and lastingly, in terms of elasticity, using the inventive sewing thread.

It should be re-emphasized here that all the above described embodiments of the inventive sewing thread, when compared to conventional sewing threads, in producing elastic seams and in particular also in producing elastic double lockstitch seams, embody essential advantages from the point of view of coat, and that the seams made using the inventive sewing thread require a clearly shorter sewing thread length, in order to make available a seam elasticity comparable to conventional sewing threads. Further to this, the inventive sewing thread for the first time enables trouble-free machining of a double lockstitch seam in elastic articles, so that the resulting double lockstich seam advantageously replaces the chain stitch seam, these days produced using conventional sewing threads, whereby as compared to the chain stitch seam such a double lockstitch seam offers additional aesthetic configuration options and is substantially friendlier to skin, since it wears out much less, as compared to the chain stitch seam. Accordingly, the inventive sewing thread can be used in particular also for sewing several, overlapping layers of material particularly advantageously.

A further object of the present invention is to provide two methods for producing the above described inventive sewing thread, which enable reproducible manufacture of this sewing thread.

This problem is solved according to the present invention by a method having the characterizing features of claim 22, as well as by a method having the characteristics of claim 24.

A first, basic method for manufacturing the inventive sewing thread provides that two or three yarn components, which are preferably either multifilament yarn components or spun yarn components, are pretwisted independently of one another, whereby each pretwisted yarn component has an elongation at break between 25% and 85%, preferably between 35% and 70%, and an elastic tensile elongation of between 30% and 95%, preferably between 50% and 80% of the elongation, determined by a measuring strength corresponding to 70% of the absolute strength of the respective sewing thread. The pretwisted yarn components are twisted with one another to form a plied thread, whereby the resulting plied yarn is then subjected to thermal, preferably hydrothermal, treatment.

It is pointed out that the term hydrothermal treatment covers any thermal treatment carried out with addition of water or in an aqueous liquor, so that treatment in a steam atmosphere, preferably in a saturated steam atmosphere or in a superheated steam atmosphere, or also treatment in an aqueous liquor, in particular in a dye liquor and/or in a brightening liquor, is to be understood in particular as hydrothermal treatment.

The advantage of the above described first principal method of the inventive method is that a high-performance sewing thread can be produced in relatively few manufacturing steps. On account of the small number of steps required in the inventive method error probability is also reduced, so that the inventive sewing thread can be manufactured particularly reproducibly and cost-effectively, having the advantages repeated herein above, so that to prevent repetition reference is made to the above mentioned embodiments of the inventive sewing thread, which are to be used similarly or identically also to the inventive method.

A particularly advantageous further development of the above described first method of the inventive method provides that in this connection the two or three yarn components, which, as already explained herein above, are preferably either multifilament yarn components or spun yarn components, and form the plied sewing thread, and are pretwisted with a twist value $\alpha$ between 50 and 130 and in particular between 70 and 100, whereby this twist is made in particular in the S-direction. Next the thus pretwisted yarn components are twisted with one another with a twist value $\alpha'$ between 80 and 160 and in particular between 95 and 125. The embodiments, as disclosed herein above for preferred further developments of the inventive plied sewing thread, apply to the preferred narrower ranges of the twist values $\alpha$ and $\alpha'$, depending on the respective yarn component, i.e. whether a multifilament yarn component or a spun yarn component is used. It was ascertained in this case that such a structured plied sewing thread displays perfect machining capability, so that thread breakage frequency during sewing, in particular with continuous sewing of several hours, is reduced to a minimum, so that with a plied sewing thread produced in this way there are no thread breaks or a maximum of up to 1.8 thread breaks per hour, as is already specified expressly in the inventive sewing thread.

The second principal method for producing the inventive yarn provides that in this connection at least two multifilament yarn components are intermingled with one another, whereby at least the core thread component, preferably each yarn component, has an elongation at break between 25% and 85%, preferably between 35% and 70%, and an elastic tensile elongation of between 30% and 95%, preferably between 50% and 80% of the elongation, determined by a measuring strength, corresponding to 70% of the absolute strength of the respective sewing thread, and whereby the intermingled yarn is subjected to thermal, preferably hydrothermal, treatment.

In contrast to the initially specified prior art according to BP 0 295 601 A this basic second option of the inventive method for manufacturing the inventive sewing thread differs to the extent that in this connection at least one such multifilament core thread component and preferably such multifilament yarn components (core and effect thread components) are used for the intermingling methods known per se, which have the above mentioned elongations at break and the above mentioned elastic tensile elongations.

The thermal treatment provided in both options of the inventive method provides that the thus manufactured sewing threads are stabilized in particular for the actual sewing procedure, so that in the sewn state they then have elastic tensile elongation, i.e. thus reversible elongation, enabling the inventive sewing thread to have the high elasticity already described previously in the inventive sewing thread, without provision of an excess yarn length in the seam, which has proved to be a particular advantage in particular with sewing of elastic articles and preferably when using double lockstitch seams.

To further increase the softness of the inventive sewing thread, a further development of the inventive method provides that in this connection two multifilament yarn components are intermingled with one another, whereby the first yarn component forming the core of the yarn is supplied to the intermingling step with an overfeed between 2% and 15%, in particular between 3% and 6%, and the second effect thread component is supplied with an overfeed between 5% and 40%, preferably between 17% and 30%. With this variant of the inventive method the overfeed of the second yarn component (effect yarn) is substantially higher than the overfeed of the first yarn component (core component), so that due to these differences in overfeed the sewing thread thus produced receives increased volume and improved softness and suppleness as well as greater wearing comfort.

Basically, with both the above described options of the inventive method for all yarn components, which form the plied sewing thread or the intermingled sewing thread, those synthetic fibers such as for example polyester fibers, polyamide 6- or polyamide 6.6 fibers can be selected, which have the above mentioned elongations at break and the previously specified elastic tensile elongations. In a particularly suitable further development of the inventive method however chemically modified polyester fibers and preferably polytrimethylene-terephthalate fibers, which are a spun yarn or a multifilament, are selected in particular for these yarn components, such that the resulting plied sewing thread or the thus intermingled sewing thread preferably exclusively comprises these multifilament poly-trimethylene-terephthalate fibers and/or spun yarns of polytrimethylene-terephthalate fibers.

A particularly suitable variant embodiment of the inventive method provides that in this connection for producing the intermingled sewing threads a multifilament polytrimethylene-terephthalate fiber is selected as first yarn component (core thread component) and a multifilament polyethylene-terephthalate fiber is selected as second yarn component, so that, when viewed over the cross-section of the thus produced intermingled sewing thread, the first yarn component, i.e. the multifilament polytrimethylene-terephthalate fiber, is covered extensively by the second yarn component, i.e. the multifilament polyethylene-terephthalate fiber. This variant of the inventive method is used in particular to produce intermingled sewing threads, which are provided for dyeing in medium and deep tones, since the dyed sewing threads thereby have a high level of color fastness, as is already described herein above for the relevant embodiment of the inventive sewing thread.

With respect to the temperature, at which the thermal treatment and in particular the hydrothermal treatment are performed, it should be ascertained that this temperature for the respective material must be above its glass transition temperature and below its melting point. Preferably, however, the thermal treatment and in particular the hydrothermal treatment, which are to be viewed as a particularly suitable variant embodiment of the inventive method, are performed at an effective temperature of between 120° C. and 200° C., whereby relevant treatment is carried out particularly preferably in an aqueous liquor. In this connection the effective temperature is determined by means of differential thermo-analysis. This differential thermo-analysis characterizes the partial melting of the crystallites in the form of an endothermal peak formed by thermal treatment and in particular by hydrothermal treatment in the fiber substrate in the non-crystalline regions, whereby this endothermal peak is defined as effective temperature of the respective thermal treatment, as is described in brief in "H. K. Rouette, Lexikon für Textilveredlung [Lexicon of textile finishing], Laumann-Verlag, Dülmen, 1995, vol. 1, pp. 390–392" and as is summarized in detail in the publication by H. J. Berndt, dissertation T H Aachen (1971) "Untersuchung an thermisch-mechanisch vorbehandelten Polyethylenglykolterephthalat—ein Beitrag zur Optimierung of the Fixiereffektes and seine Bestimmung" [Research into thermo-mechanical pretreated polyethylene glycol terephthalate—a contribution to optimizing the fixing effect and its analysis].

As already explained herein above in the inventive methods, preferably hydrothermal treatment is carried out, whereby it has proven very advantageous here in particular, if the yarn for the hydrothermal treatment is wound onto a bobbin and the bobbin wound with the yarn then undergoes hydrothermal treatment. With respect to the dwell time in such thermal treatment the dwell time in the treatment medium and in particular in the aqueous liquor generally depends on the selected temperature. At relatively low temperatures of the treatment medium or the aqueous liquor, thus for example at temperatures between 80° C. and 100° C., the dwell time usually varies between 30 minutes and 2 hours, whereas at temperatures between 100° C. and 130° C. the dwell time is between 45 minutes and 1.5 hours, preferably between 50 minutes and 70 minutes. The above mentioned temperatures indicate the temperatures of the treatment medium and in particular the bath temperatures of the aqueous liquor.

A further development of the inventive method provides that in this connection the yarn, whether the plied sewing thread or the intermingled sewing thread, is dyed and/or brightened following thermal, preferably hydrothermal, treatment. This further development of the inventive method is followed by drawing (stretching) of the dyed and/or brightened yarn, whereby this drawing in particular causes the portion of the elastic tensile elongation to increase and/or the elastic tensile elongation to stabilize, so that with repeated loading and subsequent relief the yarn retains its originally elastic behavior. In other terms this drawing of the dyed and/or brightened yarn in particular also serves to further stabilize the elasticity of the inventive sewing thread.

With respect to the temperature, at which the dyed and/or brightened yarn is drawn in the above described embodiment of the inventive method, this temperature depends on the degree of desired stabilizing of the elastic tensile elongation, i.e. thus of the elasticity of the inventive sewing thread. In particular, this drawing is performed in a temperature range between ambient temperature and 180° C., whereby particularly preferably cold drawing is performed, i.e. drawing between 15° C. and 40° C.

With the force (strength) to be applied in the above described drawing this force varies preferably between 0.2 cN/dtex to 1.5 cN/dtex, in particular between 0.3 cN/dtex and 1 cN/dtex, whereby the above mentioned values define the forces, which have an effect on the inventive yarn during the actual drawing procedure.

As already explained, in addition to the thermal, in particular hydrothermal, treatment this drawing step can be performed with the inventive method at the above mentioned forces.

From the viewpoint of a particularly rational method a further modification of the inventive method provides that in this connection also the above described preferred hydrothermal treatment is performed under tension. In order to bring about this tension behavior in the hydrothermal treatment, a further development of the inventive method puts forward that in this connection the plied or intermingled sewing thread is wound at tension onto a bobbin directly after it is manufactured, whereby on this occasion tensions are preferably employed, as were quantified herein above for the additional drawing step. But it is particularly appropriate if, in this variant of the inventive method, the plied or intermingled sewing thread is wound at such a tension onto the bobbin, giving the bobbin a winding density between 350 g/l and 550 g/l, in particular between 400 g/l and 550 g/l.

It is again specified that the inventive sewing thread or the sewing thread manufactured according to the inventive method be preferably used fabricating elastic articles. In particular however the inventive sewing thread or the sewing thread manufactured according to the inventive method is employed for making double lockstitch threads in elastic ready-made items, whereby preferred examples for such elastic ready-to-wear items are also designated as elastic articles.

In particular the inventive sewing thread is also used as embroidery yarn in the machining of embroidery patterns, preferably graphic embroidery patterns in elastic articles, because for this application it also has excellent running properties with minimized susceptance to failure during machine embroidering.

Advantageous further developments of the inventive sewing thread and the inventive method are specified in the sub-claims.

The inventive method is described in greater detail herein below by means of an example, whereby this example describes a triple plied sewing thread produced according to the inventive method.

EXAMPLE

First, three multifilament poly-trimethylene-terephthalate fibers (chemically modified polyester fibers) were pretwisted on a conventional twisting machine with an individual fineness of 84 dtex and a filament count of 36 with 820 rpm in S-direction.

Then, the thus twisted roves were twisted to form a triple plied thread with a twist revolution of 615 rpm in Z-direction. The resulting plied yarn was wound onto a bobbin directly on the twisting machine, whereby the winding density was 450 g/l.

The resulting cross-wound bobbin was then subjected to hydrothermal treatment in aqueous liquor, whereby the aqueous liquor comprised water exclusively. The dwell time for this hydrothermal treatment was 60 minutes at a final temperature of 120° C. In this connection the aqueous liquor, beginning with a starting temperature of 70° C., was heated at a heating rate of 1° C./min to 120° C., then left to stand for 60 minutes at 120° C. and then cooled to 70° C. at a cooling rate of 3° C./min.

Following this hydrothermal treatment the bobbin was then dyed in a conventional dye autoclave at 120° C. for 60 minutes, as is usual for polyester fibers. The heating characteristic of this dyeing corresponded to the above described heating characteristic for hydrothermal treatment.

The following technological data, specified in Table 1 below, were determined from the resulting sewing thread.

TABLE 1

| Technological data of the finished plied sewing thread | |
|---|---|
| fineness | 102 dtex × 3 |
| tensile strength** | 752 cN |
| elongation at break** | 68% |
| elastic tensile elongation* | 70% |
| yarn twisting | 930 turns/m S-direction |
| plied thread twisting | 720 turns/m Z-direction |
| sliding value | 143 cN |
| fineness-related tensile strength | 24 cN/tex |

**measured according to DIN EN ISO 2062

*assessed as follows: The elastic tensile elongation (also abbreviated herein below by "ZD"), of the finished sewing thread was determined according to DIN 53,835. This tensile strength in the selected example was 752 cN, as summarized in Table 1.

Next the finished sewing thread underwent 50 load cycles, whereby each load cycle comprises elongation of the sewing thread at a force corresponding to 70% of the tensile strength, and subsequent relief at a tensile strength of 20 cN (corresponds to the measured basic load). This measuring was performed in accordance with DIN 53,835.

In concrete terms a force of 526.4 cN was taken as the basis for each load cycle (plus a measured basic load of 20 cN).

On expiry of the 50 load cycles the overall elongation, herein below designated as "GD", of the sewing thread and the median value of the elongations were determined, to which the sewing thread goes back for each relief. This average value is designated herein below as "MD".

In concrete terms an overall elongation with a measuring pressure of 526.4 cN of 47.6% (GD) and a median value of the elongations according to relief (MD) of 14.28% were determined.

The elastic tensile elongation (ZD) in % is calculated according to the following formula:

$$ZD \text{ in } \% = \frac{(GD\ [\%] - MD\ [\%]) \times 100\ [\%]}{GD\ [\%]}$$

ZD=elastic tensile elongation

In concrete terms this elastic tensile elongation (ZD) is calculated as follows:

$$ZD = \frac{(47.6\% - 14.28\%) \times 100\%}{47.6\%}$$

$$ZD = 70\%$$

In addition, a steady load on the sewing thread was applied on an industrial sewing machine at a speed of 2500 rpm with the plied sewing thread using a double lockstitch, stitch type 301, DIN 61,400 at a stitch density of 5 stitches/cm, to the extent that the plied sewing thread breaks/hour were ascertained. The plied sewing thread breakage frequency with 1.8 breaks/hour was determined as median value of an overall sewing time of 5 hours.

Determining the sliding value specified in Table 1 was carried out as follows:

To determine the sliding value a measuring instrument made by Honigmann (Wuppertal, Germany) described as "HCC-$\mu$-Meter, Präzisierungs-Reibwert-Meßgerät" [precision friction value measuring instrument] was used.

The measuring principle is based on the fact that the sewing thread to be checked is drawn at a constant speed of 2 m/min, after the sewing thread has been guided by a loaded tension disk arrangement, as this corresponds to the tension disk arrangements common to sewing machines. In this connection the force required to draw the sewing thread, given in Table 1 as a sliding value, is measured.

The employed tension disk arrangement consists of two tension disks made of polished stainless steel pressed together.

A commercial standard sewing thread, type Serafil 80 (triple ply, polyethylene-terephthalate, endless; made by Amann, Germany) is used to calibrate the measuring array. In this connection the load on the tension disks is altered while the standard sewing thread is drawn off at the above mentioned speed, until a sliding value of 110 cN for this standard sewing thread is determined.

The above described measuring of the sewing thread to be checked in each case is done using the adjusted load of the tension disks.

What is claimed is:

1. A sewing thread comprising synthetic fibers, characterized in that the ready-to-use sewing thread has an elongation at break between 25% and 85% and in that the sewing thread has a elastic tensile elongation of between 30% and 95% of the elongation, which is determined at a measuring strength corresponding to 70% of the absolute strength of the respective sewing thread.

2. The sewing thread according to claim 1, characterized in that the ready-to-use sewing thread has an elongation at break between 35% and 70% and that the elastic tensile elongation of the sewing thread is between 50% to 80% of the elongation.

3. The sewing thread according to claim 1, characterized in that the sewing thread has at least one yarn component made of a chemically modified polyester fiber.

4. The sewing thread according to claim 3, characterized in that the sewing thread contains multifile polytrimethylene-terephthalate fibers as chemically modified polyester fibers.

5. The sewing thread according to claim 3, characterized in that the sewing thread contains fiber yarns of polytrimethylene-terephthalate fibers as chemically modified polyester fibers.

6. The sewing thread according to claim 4, characterized in that the sewing thread consists of the multifile polytrimethylene-terephthalate fibers and/or the spun yarns of poly-trimethylene-terephthalate fibers.

7. The sewing thread according to claim 6, characterized in that the sewing thread has the structure of a plied sewing thread and in that the plied sewing thread has at least two twisted yarn components.

8. The sewing thread according to claim 6, characterized in that the twisted yarn components are given a pretwisting and in that the pretwisted twisted yarn components are twisted with one another to form the plied sewing thread.

9. The sewing thread according to claim 8, characterized in that the pretwisting has a twist value a between 50 and 130.

10. The sewing thread according to claim 8, characterized in that the plied sewing thread has a twist value $\alpha'$ between 80 and 160.

11. The sewing thread according to claim 1, characterized in that the sewing thread has the structure of a intermingled yarn, and that the intermingled yarn includes at least a first yarn component forming the core of the yarn and at least a second yarn component intermingled with the latter, whereby the second yarn component forms the effect yarn component.

12. The sewing thread according to claim 11, characterized in that both the first yarn component and the second yarn component exclusively comprises the chemically modified multifile polyester fibers.

13. The sewing thread according to claim 11, characterized in that only the first yarn component comprises the chemically modified multifile polyester fibers and in that the second yarn component is formed from the multifile polyethyleneterephthalate fibers.

14. The sewing thread according to claim 11, characterized in that the mass ratio of the first yarn component to the second yarn component varies between 60:40 to 80:20.

15. The sewing thread according to claim 11, characterized in that the sewing thread is given a twist between 0 rpm and 500 rpm.

16. The sewing thread according to claim 1, characterized in that the sewing thread has a hot-air shrinkage at 180° C. between 0.5% and 3% and a boiling shrinkage at 98° C. in water between 0.1% and 1.5%.

17. The sewing thread according to claim 1, characterized in that the sewing thread has an absolute strength between 400 cN and 1,800 cN.

18. The sewing thread according to claim 1, characterized in that the sewing thread has a specific strength between 10 cN/tex and 60 cN/tex, preferably between 14 cN/tex and 34 cN/tex.

19. The sewing thread according to claim 1, characterized in that the sewing thread has an overall fineness between 100 dtex and 1,800 dtex, preferably between 200 dtex and 1,200 dtex.

20. The sewing thread according to claim 1, characterized in that the chemically modified polyester fibers has a single filament count between 18 filaments and 90 filaments.

21. The sewing thread according to claim 1, characterized in that the sliding value of the sewing thread varies between 130 cN and 200 cN.

* * * * *